US008020231B2

(12) United States Patent
Lee et al.

(10) Patent No.: US 8,020,231 B2
(45) Date of Patent: Sep. 20, 2011

(54) CONTROL METHOD OF WASHING MACHINE

(75) Inventors: In Ju Lee, Yongin-si (KR); Jong Sung Park, Seoul (KR); Jung Soo Lim, Hwaseong-si (KR); Sang Yeon Pyo, Suwon-si (KR); Woo Kyung Jung, Suwon-si (KR); Hye Ryung Kim, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 136 days.

(21) Appl. No.: 12/403,450

(22) Filed: Mar. 13, 2009

(65) Prior Publication Data

US 2010/0000574 A1 Jan. 7, 2010

(30) Foreign Application Priority Data

Jul. 4, 2008 (KR) ..... 10-2008-65149
Oct. 20, 2008 (KR) ..... 10-2008-102775

(51) Int. Cl.
*D06F 33/02* (2006.01)

(52) U.S. Cl. ..... 8/158; 68/12.02

(58) Field of Classification Search ..... 68/12.01, 68/12.12, 15; 8/158
See application file for complete search history.

(56) References Cited

U.S. PATENT DOCUMENTS 3,702,069 A * 11/1972 Sharpe ..... 68/12.18
3,770,376 A * 11/1973 Sharpe ..... 8/158
6,954,995 B2 * 10/2005 Kitamura et al. ..... 34/597
2006/0162743 A1 7/2006 Park
2008/0095660 A1 * 4/2008 Wong et al. ..... 422/11
2009/0271930 A1 * 11/2009 Cho et al. ..... 8/137

FOREIGN PATENT DOCUMENTS

DE 197 51 028 * 5/1999
DE 10 2006 024 505 * 5/2007
DE 102006024505 5/2007
JP 59-085688 * 5/1985

(Continued)

OTHER PUBLICATIONS

WIPO WO 2007/020282 Feb. 2007.*

(Continued)

*Primary Examiner* — Frankie L Stinson
(74) *Attorney, Agent, or Firm* — Staas & Halsey LLP

(57) ABSTRACT

A control method of a washing machine is capable of safely achieving a tub washing operation control with low power consumption. At the time of performing tub washing, water of which the amount is decided depending on a volume inside a drum and a volume inside a water tub is supplied to the water tub, and the rotation speed of the drum is controlled to be inversely proportional to the volume of the supplied water, thereby efficiently controlling a tub washing operation with low power consumption. Also, the rotation state of the drum is controlled, at the time of performing the tub washing, to maintain the temperature of a motor or a printed circuit board (PCB) to be a predetermined level or less, thereby safely controlling a tub washing operation with low power consumption. In addition, it is determined whether the revolutions per minute (RPM) of the drum rotating at the tub washing operation belong to a resonance band, and the RPM are controlled such that the RPM deviate from the resonance band, thereby achieving a tub washing operation procedure with small noise and vibration.

7 Claims, 10 Drawing Sheets

FOREIGN PATENT DOCUMENTS

| | | | |
|---|---|---|---|
| JP | 02-161997 | * | 6/1990 |
| JP | 11-244581 | * | 9/1999 |
| JP | 2006-167243 | * | 6/2006 |
| JP | 2007-244849 | * | 9/2007 |
| KR | 2001-0093969 | | 10/2001 |
| KR | 2006003734 | * | 1/2006 |
| KR | 10-2006-0082689 | | 7/2006 |
| KR | 10-2006-0085961 | | 7/2006 |
| KR | 2006085961 | * | 7/2006 |
| KR | 2006085962 | * | 7/2006 |
| KR | 10-2006-0101951 | | 9/2006 |
| KR | 2006101951 | * | 9/2006 |
| WO | 2006/090973 | | 8/2006 |

OTHER PUBLICATIONS

European Search Report, mailed Sep. 21, 2009, in corresponding European Application No. 09163432.9 (4 pp.).

* cited by examiner

FIG. 3A

| OPERATION | AMOUNT OF WATER | rpm | TIME |
|---|---|---|---|
| HEATING ( a ) | 6L | 100 rpm 120 sec, 0 rpm 5 sec | 25~30 min |
| MAINTAINING(70°C) ( b ) | | | 30 min |
| RINSING (HIGH-SPEED ROTATION) ( c ) | ADDITION OF 3L | 200 rpm 120 sec, 50 rpm 20 sec (FOUR-TIME REPETITION ) | 10 min |

CONTROL METHOD OF WASHING MACHINE

CROSS-REFERENCE TO RELATED APPLICATIONS

This application claims the benefit of Korean Patent Application No. 2008-0065149, filed on Jul. 4, 2008 in the Korean Intellectual Property Office, and Korean Patent Application No. 2008-102775, filed on Oct. 20, 2008 in the Korean Intellectual Property Office, the disclosures of which are incorporated herein by reference.

BACKGROUND

1. Field

The present invention relates to a control method of a washing machine, and, more particularly, to a control method of a washing machine capable of safely achieving tub washing operation control with low power consumption.

2. Description of the Related Art

Generally, the washing of laundry in a washing machine is achieved by sequentially performing a washing operation, a rinsing operation, and a spin-drying operation for a predetermined time while the laundry and a predetermined amount of detergent are included in a drum.

After the washing of the laundry by the washing machine is completed, detergent waste or contaminants separated from the laundry may be left in a water tub (or tub) and the drum. As the washing machine is repeatedly used for a long period of time, bacteria and mold may inhabit the water tub. The contamination in the washing machine gives off a terrible smell, propagates bacteria, and re-contaminates clothes washed in the washing machine, which harms human bodies.

Consequently, the final operation method of the washing machine generally includes an additional water tub washing procedure to remove contaminants or detergent waste left in the tub and the drum. The water tub washing procedure generally includes removing contaminants left in the water tub and the drum using hot water or steam and supplying water into the water tub to rinse the water tub and the drum.

SUMMARY

Therefore, it is an aspect of the present invention to provide a control method of a washing machine capable of wholly sterilizing and washing a drum with a minimum amount of water concurrently with a tub washing, and rinsing the drum with a minimum amount of water.

It is another aspect of the present invention to provide a control method of a washing machine capable of determining the temperature of a unit such as a motor or a printed circuit board (PCB) during the tub washing and controlling the rotation state of the drum according to the determined temperature, thereby achieving tub washing operation control.

It is another aspect of the present invention to provide a control method of a washing machine capable of controlling an on/off cycles and rotation speed of the motor during the tub washing to control the rotation state of the drum, thereby achieving tub washing operation control.

It is a further aspect of the present invention to provide a control method of a washing machine capable of determining whether revolutions per minute (RPM) of the motor belong to a resonance band with respect to the vibration of the washing machine during the tub washing, and, when it is determined that the RPM of the motor belong to the resonance band, raising or lowering the RPM of the motor, thereby achieving tub washing operation control.

Additional aspects and/or advantages of the invention will be set forth in part in the description which follows and, in part, will be apparent from the description, or may be learned by practice of the invention.

In accordance with one aspect of the present invention, there is provided a control method of a washing machine, including supplying water to a water tub concurrently with performing a tub washing, heating the supplied water, rotating a drum, at a speed at which the supplied water uniformly reaches a top of the water tub, to wash the water tub and the drum.

A volume of the supplied water may be determined by the following equation.

$$VW1 = (V_T - V_D)/(2\sim3)$$

Where $V_{W1}$=the volume of the supplied water, $V_T$=a volume inside the water tub, and $V_D$=a volume inside the drum.

The rotation speed of the drum during the washing operation may be determined in reverse proportion to a volume of the water supplied during the water supply operation.

The rotation speed of the drum may be determined by the following equation.

$$RPM = (V_T - V_D)/(2\sim3)*(15\sim20)$$

Where RPM=revolutions per minute of the drum, $V_T$=a volume inside the water tub, and $V_D$=a volume inside the drum.

The control method may further include replenishing a predetermined volume of replenishment water to the water tub after the washing operation, and rotating the drum, at a speed at which the replenishment water uniformly reaches the top of the water tub, to rinse out the water tub and the drum.

The volume of the replenishment water may be determined by the following equation.

$$V_{W2} = (V_T - V_D)/(1.8\sim2.2) - V_{W1}[L]$$

Where $V_{W2}$=the volume of the replenishment water, $V_{W1}$=a volume of the supplied water, $V_T$=a volume inside the water tub, and $V_D$=a volume inside the drum.

The rotation speed of the drum during the rinsing operation may be determined in reverse proportion to the volume of the water supplied during the replenishment operation.

The rotation speed of the drum at the rinsing operation may be determined by the following equation.

$$RPM = (V_T - V_D)/(1.8\sim2.2)*(20\sim30)$$

Where RPM=revolutions per minute of the drum, $V_T$=a volume inside the water tub, and $V_D$=a volume inside the drum.

In accordance with another aspect of the present invention, there is provided a control method of a washing machine, including determining a temperature change amount of a unit such as a motor or a printed circuit board (PCB) mounted in the washing machine concurrently with performing a tub washing, and controlling a rotation state of the drum according to the temperature change amount to prevent the unit such as the motor or the PCB from overheating.

The controlling the rotation state of the drum may be performed in a manner to control a rotation speed or on/off cycles of the motor to rotate the drum.

The tub washing may be performed through a plurality of operations, and the rotation state of the drum may be controlled in a combination of a manner to control a rotation speed of the motor to rotate the drum or a manner to control on/off cycles of the motor during the operations.

The operations may include a heating operation and a maintaining operation, and the rotation state of the drum may be controlled in a manner to control the on/off cycles of the motor during the heating operation and the maintaining operation.

The operations may include a rinsing operation, and the rotation state of the drum may be controlled in a manner to control the speed of the motor during the rinsing operation.

The control method may further include sensing a vibration signal concurrently with performing the tub washing, determining whether the vibration signal has entered a resonance band, and, when it is determined that the vibration signal has entered the resonance band, increasing a rotation speed of the motor such that the vibration signal deviates from the resonance band.

In accordance with a further aspect of the present invention, there is provided a control method of a washing machine, including stirring or rotating a drum at the time of performing a tub washing, and controlling a rotation speed or on/off cycles of a motor to stir or rotate the drum at predetermined time intervals to control a rotation state of the drum.

The tub washing may be performed through a plurality of operations, and a manner to control the rotation speed of the motor or a manner to control the on/off cycles of the motor may be used in combination during the operations.

The operations may include a heating operation and a maintaining operation, and the rotation state of the drum may be controlled in a manner to control the on/off cycles of the motor during the heating operation and the maintaining operation.

On/off cycles of the motor may be set to be different at the respective operations.

The operations may include a rinsing operation, and the rotation state of the drum may be controlled in a manner to control the speed of the motor during the rinsing operation.

The control method may further include sensing a vibration signal of the washing machine, determining whether the vibration signal has entered a resonance band, and, when it is determined that the vibration signal has entered the resonance band, increasing the rotation speed of the motor such that the vibration signal deviates from the resonance band.

Also in accordance with a further aspect of the present invention, there is provided a washing machine including a water tub receiving water supplied to the washing machine, a heater heating the supplied water, a drum rotating the supplied water uniformly at a speed at which the supplied water reaches a top of the water tub, and a controller controlling a volume of the water supplied to the water tub, the heater, and the drum.

In accordance with another aspect of the present invention, there is provided a unit mounted in the washing machine, wherein the controller determines an amount of temperature change of the unit while the drum is rotating the supplied water and controls the rotating of the drum according to the amount of temperature change to prevent the unit from overheating.

In accordance with a further aspect of the present invention, the controller controls the drum to rotate at predetermined time intervals.

In accordance with another aspect of the present invention, a controller senses a vibration signal, determines whether vibration signal is within a resonance band, and increases speed of drum rotation such that the vibration signal deviates from the resonance band.

BRIEF DESCRIPTION OF THE DRAWINGS

These and/or other aspects and advantages of the invention will become apparent and more readily appreciated from the following description of the embodiments, taken in conjunction with the accompanying drawings of which:

FIG. 3A is a table illustrating the specification of a tub washing operation according to an embodiment of the present invention;

DETAILED DESCRIPTION OF EMBODIMENTS

Figure 1:
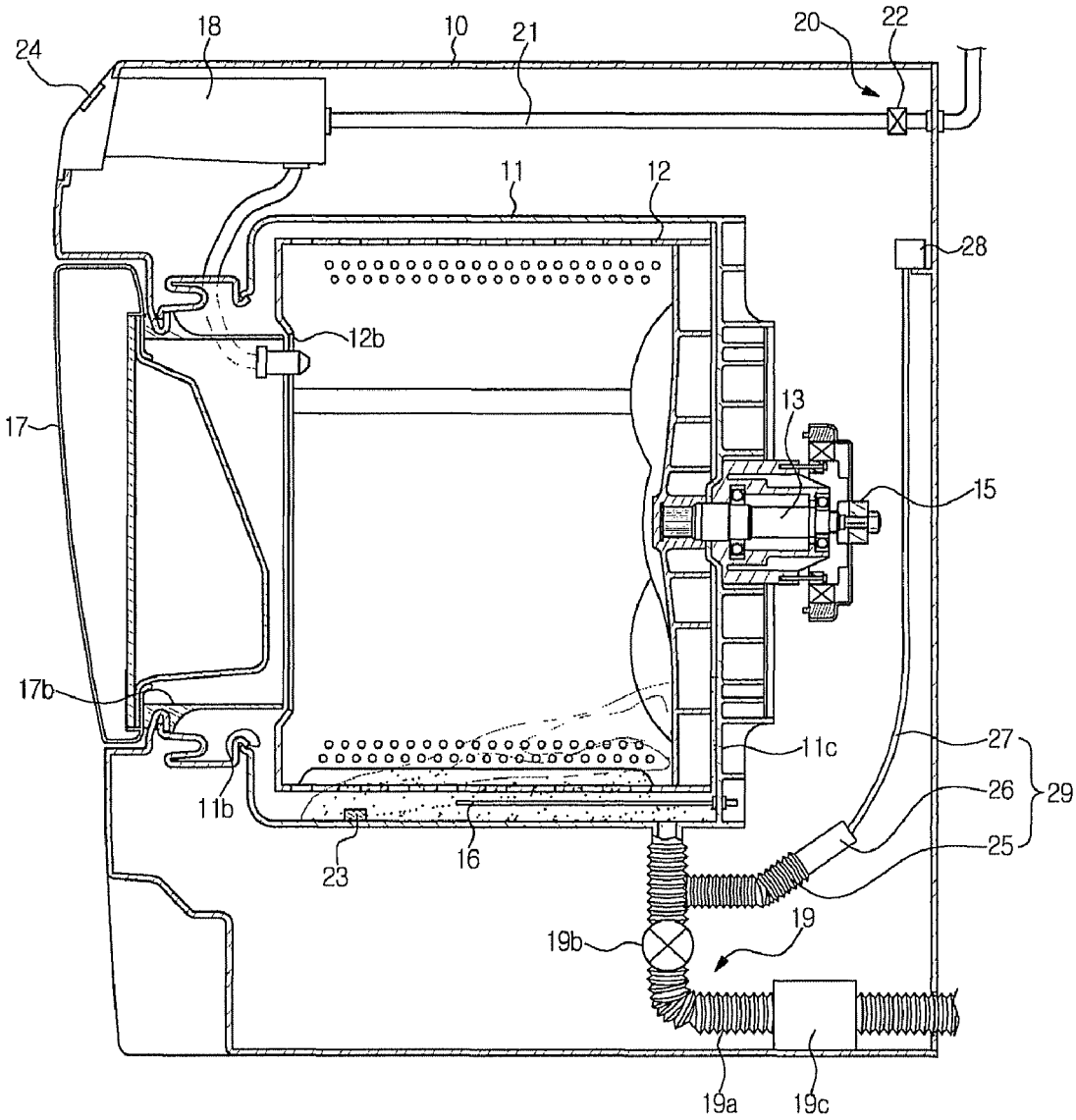
FIG. 1 is a sectional view illustrating the structure of a washing machine according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

FIG. 1 is a sectional view illustrating a structure of a washing machine according to an embodiment of the present invention.

As shown in FIG. 1, the washing machine includes a drum type water tub 11 mounted in a machine body 10 to receive wash water and a rotary drum 12 rotatably mounted in the water tub 11.

Outside a rear 11*c* of the water tub 11 is mounted a motor 15 to rotate a rotary shaft 13 connected to the rotary drum 12 such that washing, rinsing, and spin-drying operations are performed by the washing machine. In the lower part of the water tub 11 is mounted a washing heater 16 to heat wash water supplied into the water tub 11.

Above the water tub 11 are mounted a detergent supply unit 18 to supply detergent, a water supply unit 20 including a water supply pipe 21 to supply water to the water tub 11 and a water supply valve 22 mounted on the water supply pipe 21 to control the supply of water through the water supply pipe 21, and a vibration sensor 30 to sense the vibration of the water tub 11.

Below the water tub 11 is mounted a drainage unit 19 including a drainage pipe 19*a* to drain water from the water tub 11, a drainage valve 19*b* to control the drainage of water to the outside, and a drainage pump 19*c* to pump out water from the water tub 11.

At the inside bottom of the water tub 11 is mounted a temperature sensor 23 to measure the temperature of wash water in the washing machine.

At the front of the machine body 10 is formed an inlet port 17*b*, corresponding to an inlet port 12*b* of the rotary drum 12 and an inlet port 11*b* of the water tub 11, to allow laundry to be put into or removed from the rotary drum 12 therethrough. At the inlet port 17*b* is mounted a door 17 to open and close the inlet port 12*b*.

At the upper front of the machine body 10 is mounted a control panel 24 to allow a user to input a washing operation, a rinsing operation, and a spin-drying operation or a predetermined procedure, such as a tub washing procedure.

A water level sensing mechanism 29 senses the level of water supplied into the water tub 11. The water level sensing mechanism 29 includes a water level sensing unit 25 connected to one side of the drainage unit 19, an air chamber 26 connected to the lower end of the water level sensing unit 25, the air chamber 26 being filled with air to which a pressure is applied depending upon the level of water in the water level sensing unit 25, a water level sensing tube 27 having the lower end connected to one end of the air chamber 26, and a water level sensor 28 to which the upper end of the water level sensing tube 27 is connected, the water level sensor 28 to sense the pressure of air in the water level sensing tube 27 to sense the water level.

Figure 2:
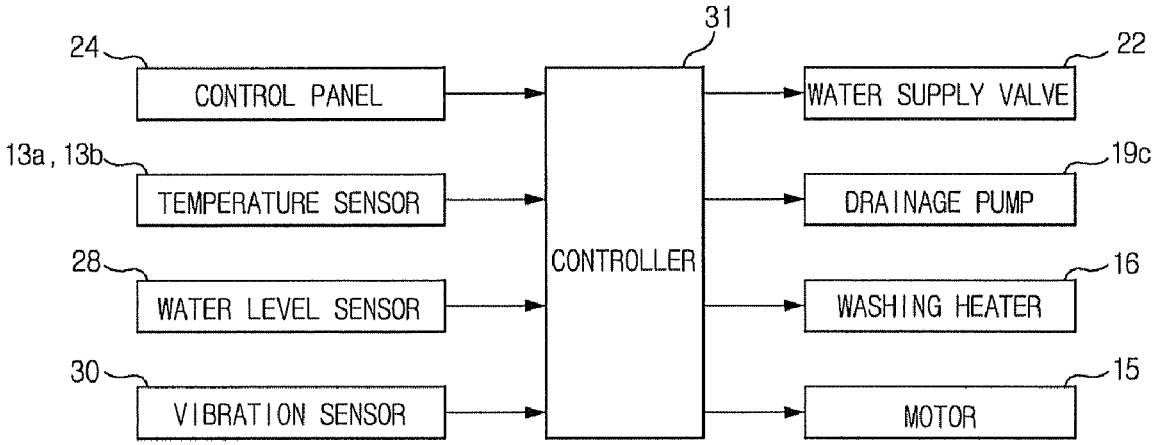
FIG. 2 is a control block diagram of the washing machine according to the embodiment of the present invention.

On the other hand, the water level sensor 28 measures the level of water filled in the water tub 11, during a tub washing, and transmits measured information to a controller 31 (shown in FIG. 2).

FIG. 2 is a control block diagram of the washing machine.

As shown in FIG. 2, when a user inputs or selects a tub washing procedure, the control panel 24 transmits inputted information, including the tub washing procedure, to the controller 31.

The controller 31 controls the water supply valve 22, the drainage pump 19*c*, the washing heater 16, and the motor 15 according to the inputted tub washing procedure, the temperature measured by the temperature sensor 23, and the water level sensed by the water level sensor 28.

Also, the controller 31 confirms a vibration signal measured by the vibration sensor 30. When the controller 31 determines that the vibration signal has entered a resonance band, the controller 31 rapidly increases revolutions per minute (RPM) of the motor 15 such that the vibration signal deviates from the resonance band. That is, when the controller 31 determines that the vibration signal is in the resonance band, the controller 31 varies the speed of the motor 15, indicated in revolutions per minute (RPM), to remove the vibration signal from the resonance band.

Figure 3B:
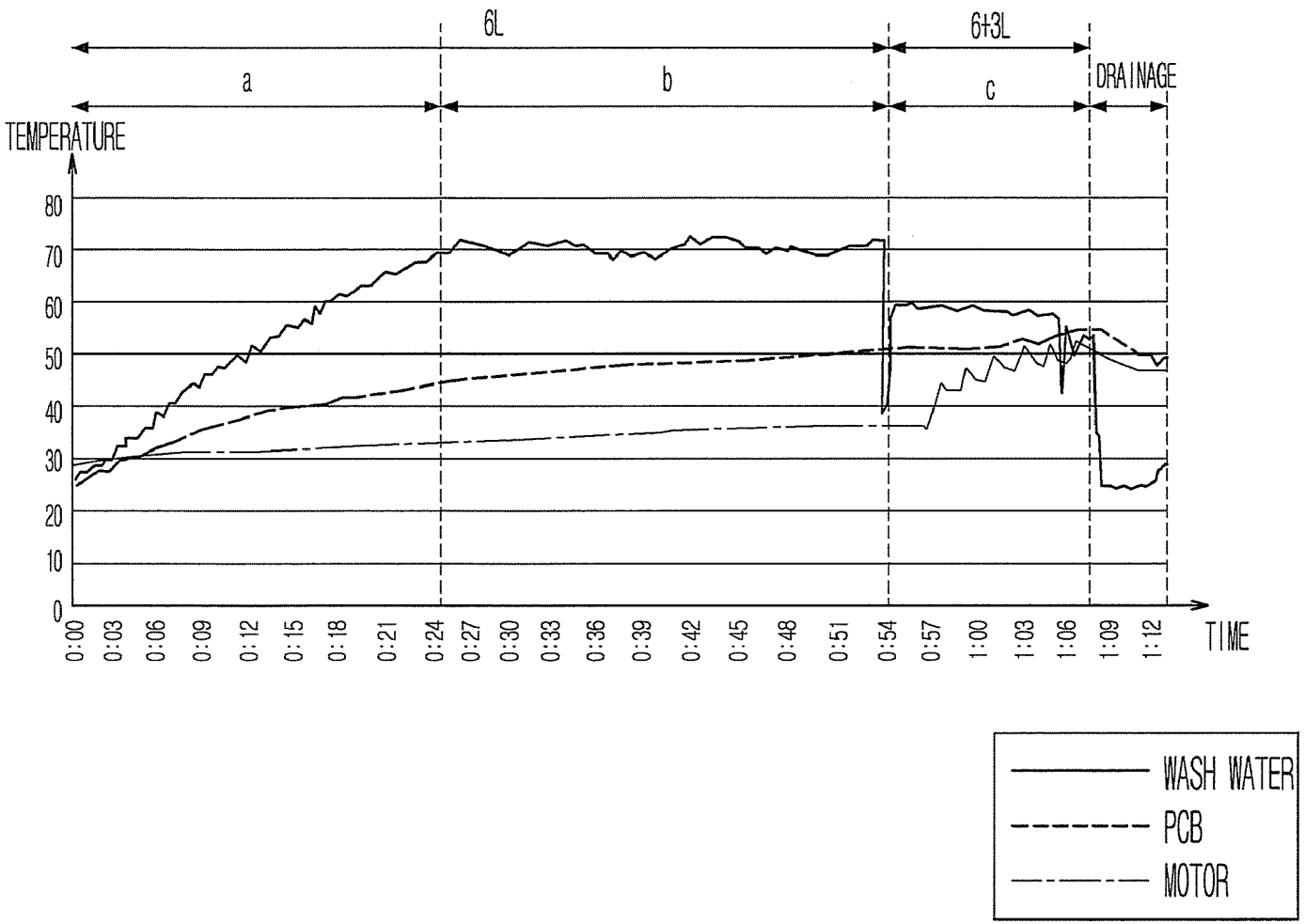
FIG. 3B is a graph illustrating temperature changes based on the tub washing operation according to the embodiment of the present invention.

FIG. 3A is a table illustrating the specification of a tub washing operation according to an embodiment of the present invention, and FIG. 3B is a graph illustrating temperature changes based on the tub washing operation.

As shown in FIG. 3A, when a tub washing is commenced, an amount of water, number of revolutions per minute (RPM), and operation time are controlled for respective operations a, b, and c of the tub washing operation.

The operation time for each operation is a value arbitrarily decided by manufacturers, and the amount of water and the RPM are decided by a concrete numerical formula and a PCB (or motor) controlprocedure, which will be described in detail with reference to FIGS. 5 and 6.

FIG. 3B is a graph illustrating temperatures of the wash water, the PCB, and the motor 15 measured at the tub washing operation. The graph shows that the motor 15 and the PCB are maintained at a temperature of a predetermined value or less by controlling the RPM and the on/off cycles of the motor 15 at the respective operations a, b, and c. That is, the motor 15 is turned on/off at predetermined time intervals or the RPM of the motor 15 are adjusted by controlling the driving of the PCB controlling the motor 15 during the tub washing, thereby preventing the temperature of the PCB and the motor 15 from continuously increasing.

Although the on/off cycles of the motor 15 are set to be the same at the heating operation a and at the maintaining operation b in FIGS. 3A and 3B, the on/off cycles may be set to be different at the respective operations.

Figure 4:
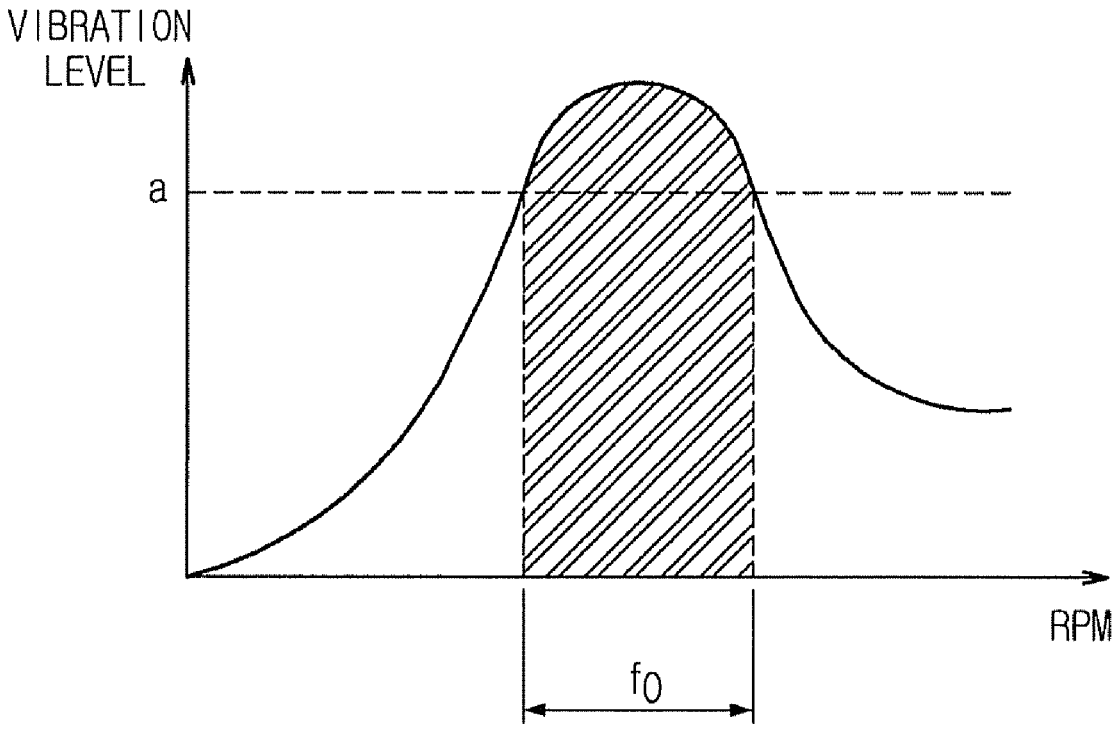
FIG. 4 is a view illustrating a resonance band based on the vibration of the washing machine according to the embodiment of the present invention.

FIG. 4 is a view illustrating a resonance band of the washing machine.

As shown in FIG. 4, the machine body 10 of the washing machine vibrates as the RPM of the motor 15 increase. The controller 31 compares a growth gradient of a vibration signal measured by the vibration sensor 30 with a predetermined value a. When it is determined that the vibration signal has entered a resonance band $f_0$, the controller 31 controls the RPM of the motor 15 to increase such that the vibration signal deviates from the resonance band $f_0$ (an excessive vibration section).

That is, when the motor 15 rotates, the vibration sensor 30 measures vibration. The controller 31 calculates a growth gradient of the vibration signal in real time according to the measured vibration value, and determines whether the vibration signal has entered the resonance band $f_0$ according the calculated growth gradient of the vibration signal. When the controller 31 has determined that the vibration signal has entered the resonance band $f_0$, the controller 31 controls the RPM of the motor 15 to increase such that the vibration signal deviates from the resonance band $f_0$. That is, when the controller 31 determines that the vibration signal has entered the resonance band $f_0$, the controller 31 increases the speed of the motor 15 to remove the vibration signal from the resonance band $f_0$.

The control operation of the controller 31 is performed according to an embodiment of the present invention. When the RPM are decided by a numerical formula to obtain the RPM, which will be described below, the controller 31 determines whether the RPM obtained by the calculation using the vibration signal transmitted from the vibration sensor 30 belong to the resonance band $f_0$. When the controller 31 has determined that the RPM belong to the resonance band $f_0$, the controller 31 controls the RPM to increase such that the vibration signal deviates from the resonance band $f_0$ (the excessive vibration section), thereby reducing noise and vibration.

Figure 5:
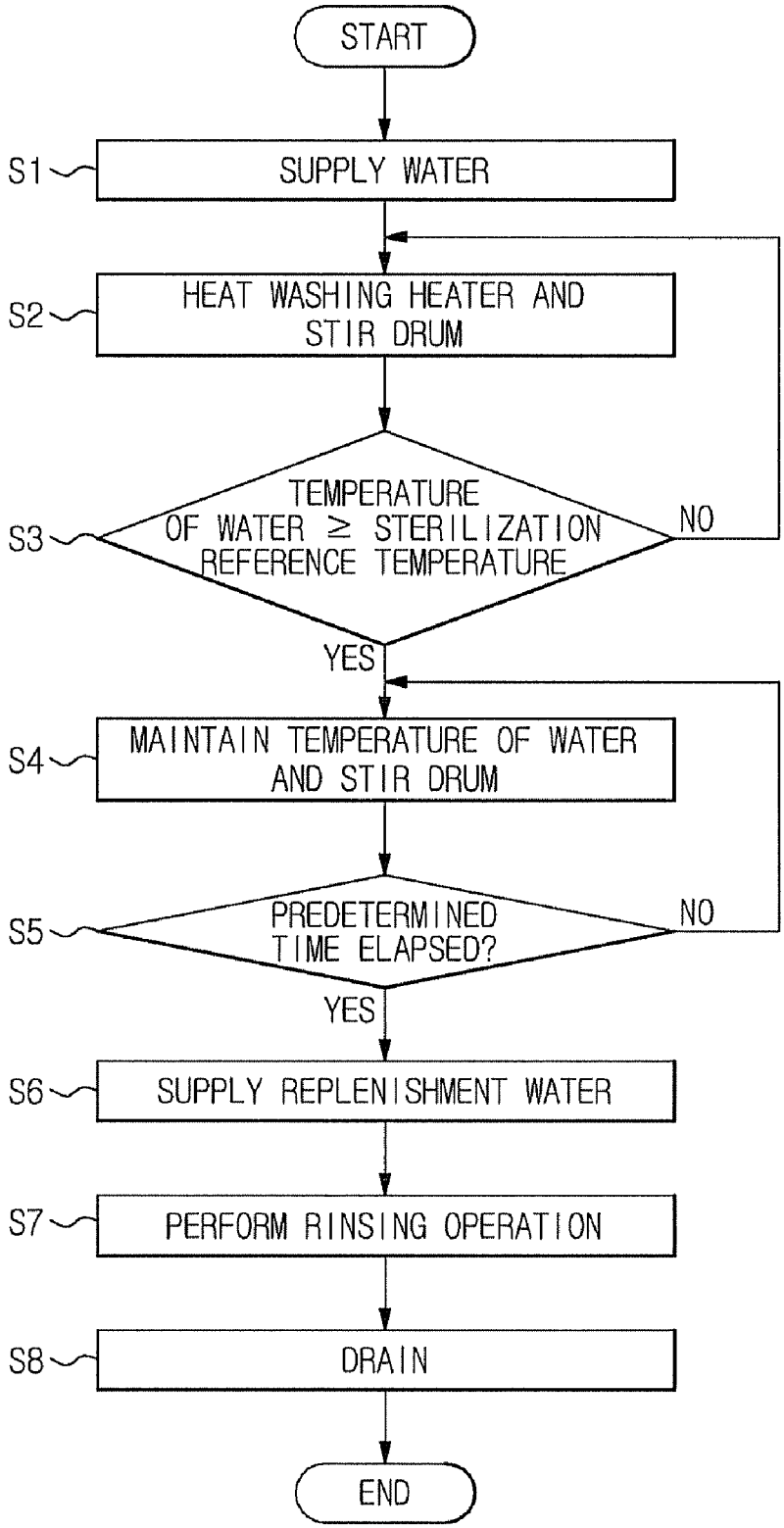
FIG. 5 is a flow chart illustrating a tub washing process of the washing machine according to the embodiment of the present invention.

FIG. 5 is a flow chart illustrating a tub washing process of the washing machine according to the embodiment of the present invention.

As shown in FIG. 5, when a tub washing process is performed, water is supplied such that heated water and vapor can sufficiently sterilize and wash the entire water tub during the rotation of the drum. The volume of the water is determined by the following equation (S1).

$$V_{W1}=(V_T-V_D)/(2\text{-}3)[L] \quad ①$$

Where $V_{W1}$ =the volume of the supplied water, $V_T$=the volume inside the water tub, and $V_D$=the volume inside the drum.

Subsequently, the supplied water is heated to a predetermined sterilization reference temperature sufficient to sterilize microorganisms (for example, 70° C.) by the washing heater, and, at the same time, the stirring of the drum is performed to accelerate the heating of the water (S2).

Meanwhile, the stirring speed of the drum is a speed at which the vapor of the water supplied according to Equation ① can reach the top of the water tub. The rotation speed of the drum for this is decided by the following equation.

$$RPM=(V_T-V_D)/(2\sim3)*(15\sim20) \quad ②$$

Where RPM=revolutions per minute of the drum.

That is, the RPM of the drum for the tub washing are obtained by calculating a speed at which hot water and vapor generated by heating the water supplied according to the amount obtained by Equation ① sufficiently sterilize and wash the entire water tub using a numerical formula.

Meanwhile, when the volume of the water supplied at the water supply operation decreases, the rotation speed of the drum, to rotate the supplied water, increasesaccordingly. Specifically, when the volume of the water supplied at the water supply operation is $(V_T-V_D)/2$, the rotation speed of the drum becomes $(V_T-V_D)/3*(15\sim20)$. On the other hand, when the volume of water supplied at the water supply operation is $(V_T-V_D)/3$, the rotation speed of the drum becomes $(V_T-V_D)/2*(15\sim20)$.

Subsequently, the temperature sensor 23 measures whether the temperature of the water reaches the sterilization reference temperature. When the temperature of the water reaches the sterilization reference temperature, the washing heater 16 is controlled to be on/off to maintain the temperature of the water, and the drum 12 is continuously stirred to sterilize the microorganisms in the washing machine. When the temperature of the water is less than the sterilization reference temperature, the heating of the washing heater and the stirring of the drum are continued (S3 and S4).

Subsequently, when it is determined at operation S4 that the sterilization of the microorganisms in the washing machine has been performed for a predetermined time by the maintenance in temperature of the water and the continuous stirring of the drum, replenishment water is supplied into the water tub to rinse out the sterilized microorganisms and organisms. At this time, the volume of the replenishment water is decided by the following equation.

$$V_{W2}=(V_T-V_D)/(1.8\sim2.2)-V_{W1}[L] \quad ③$$

Where, $V_{W2}$=the volume of the replenishment water.

That is, water sufficient to wet the entire water tub by the rotation of the drum is replenished into the water tub (S5 and S6).

Subsequently, when the supply of the replenishment water according to Equation ③ is completed, the drum is rotated at a high speed to perform a rinsing operation. At this time, the rotation speed of the drum is determined by the following equation such that the rinsing operation is performed with the maximum efficiency in correspondence to the volume of the replenishment water, and the water supplied into the water tub wets the entire water tub.

$$RPM=(V_T-V_D)/(1.8\sim2.2)*(20\sim30) \quad ④$$

That is, the RPM of the drum for the rinsing operation are calculated such that the water supplied into the water tub can wet the entire water tub (S7).

Meanwhile, when the volume of the supplied water decreases, the rotation speed of the drum, to rotate the supplied water, increases accordingly. Specifically, when the total volume $V_W+V_{W2}$ of the supplied water is $(V_T-V_D)/1.8$, the rotation speed of the drum becomes $(V_T-V_D)/2.2*(15\sim20)$. On the other hand, when the total volume $V_{W1}+V_{W2}$ of the supplied water is $(V_T-V_D)/2.2$, the rotation speed of the drum becomes $(V_T-V_D)/1.8*(20\sim30)$.

When the rinsing operation to rinse out the sterilized microorganisms and organisms is completed, a drainage operation is performed (S8). Of course, the sterilization reference temperature or the temperature maintenance time may be changed by an algorithm set in the controller 31 at the time of the manufacture.

Figure 6A:
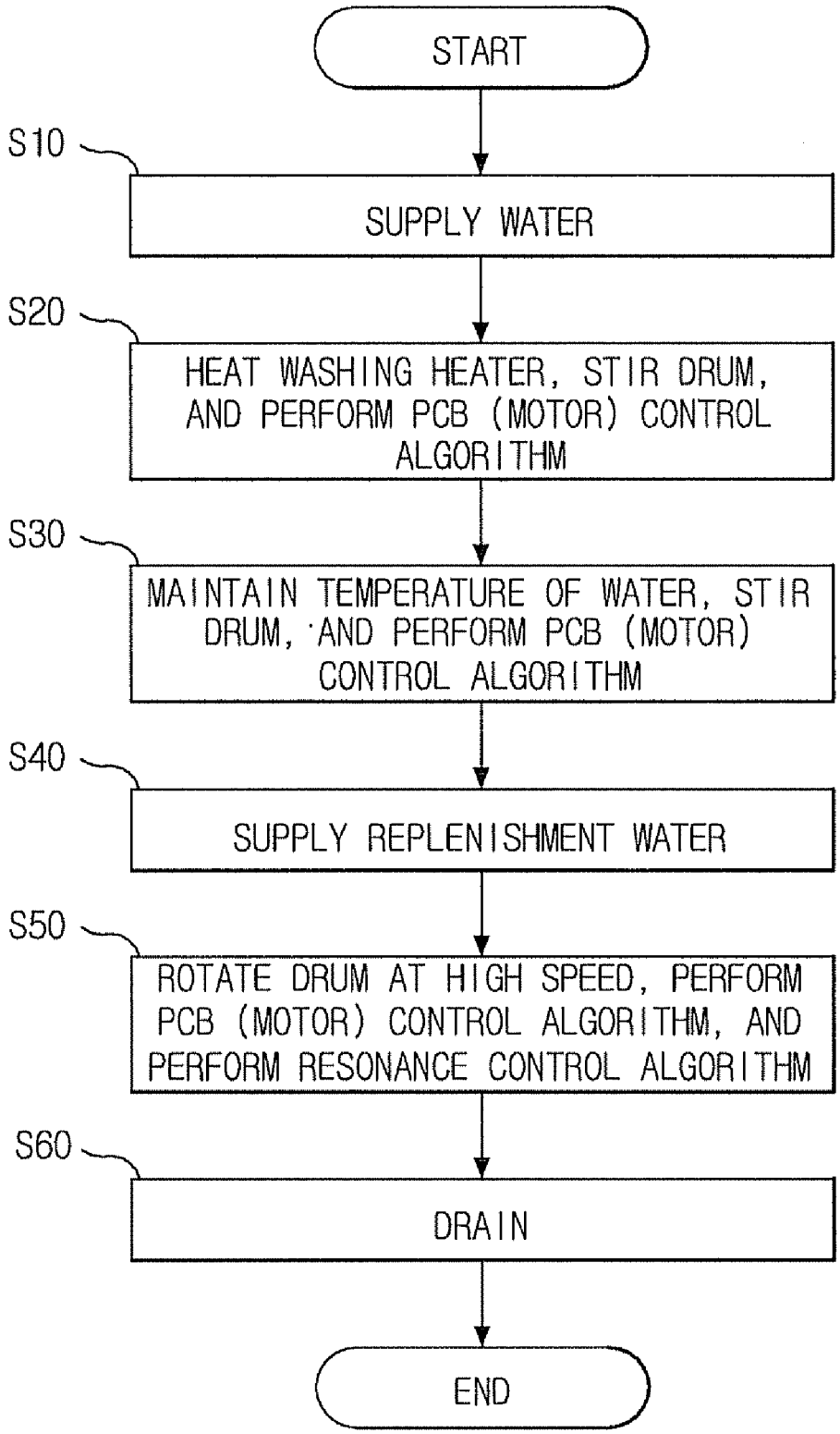
FIG. 6A is a flow chart illustrating a tub washing process of the washing machine according to an embodiment of the present invention.
Figure 6B:
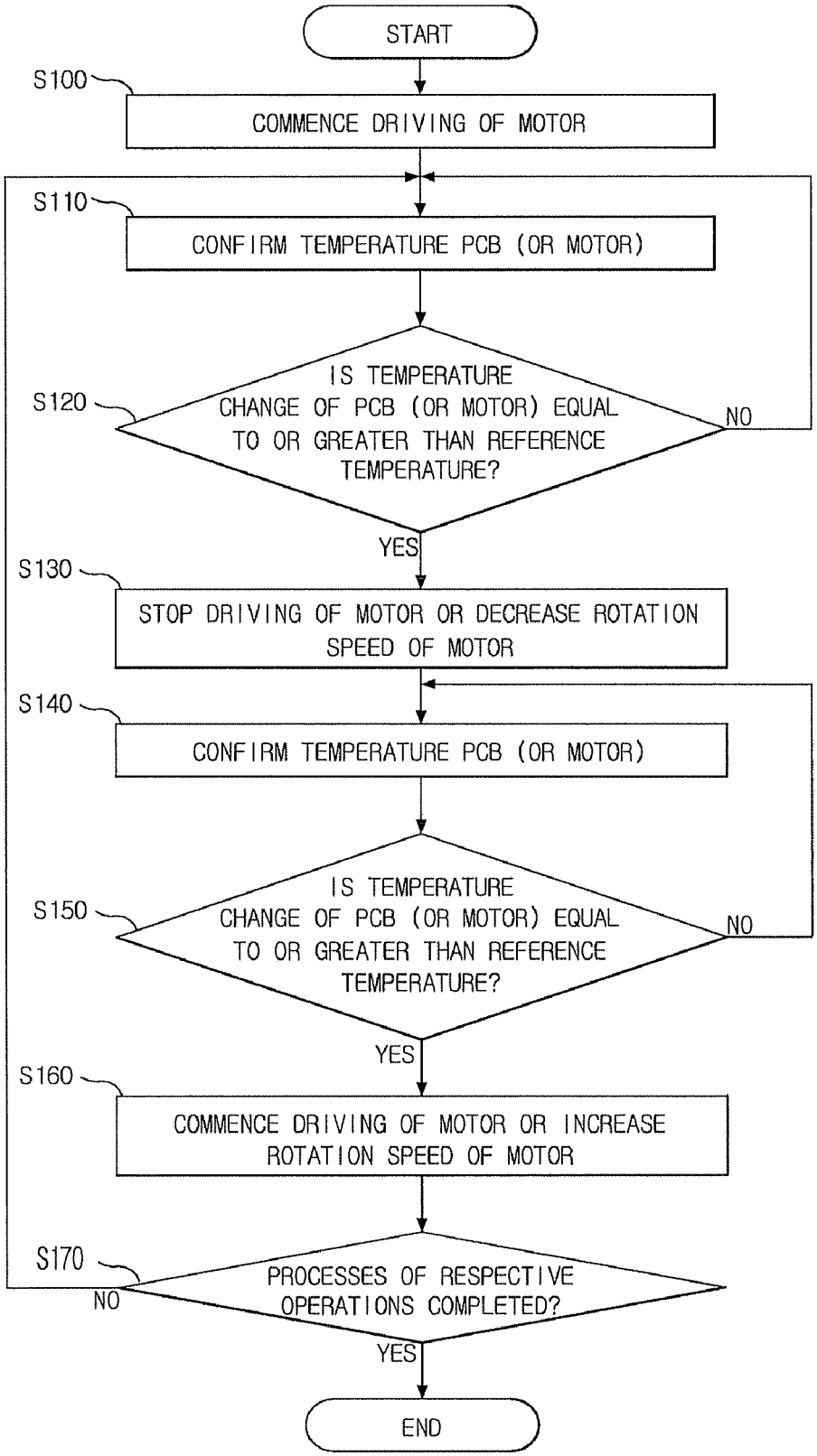
FIGS. 6B and 6C are flow charts illustrating printed circuit board (PCB) (or motor) control procedures according to embodiments of the present invention.
Figure 6C:
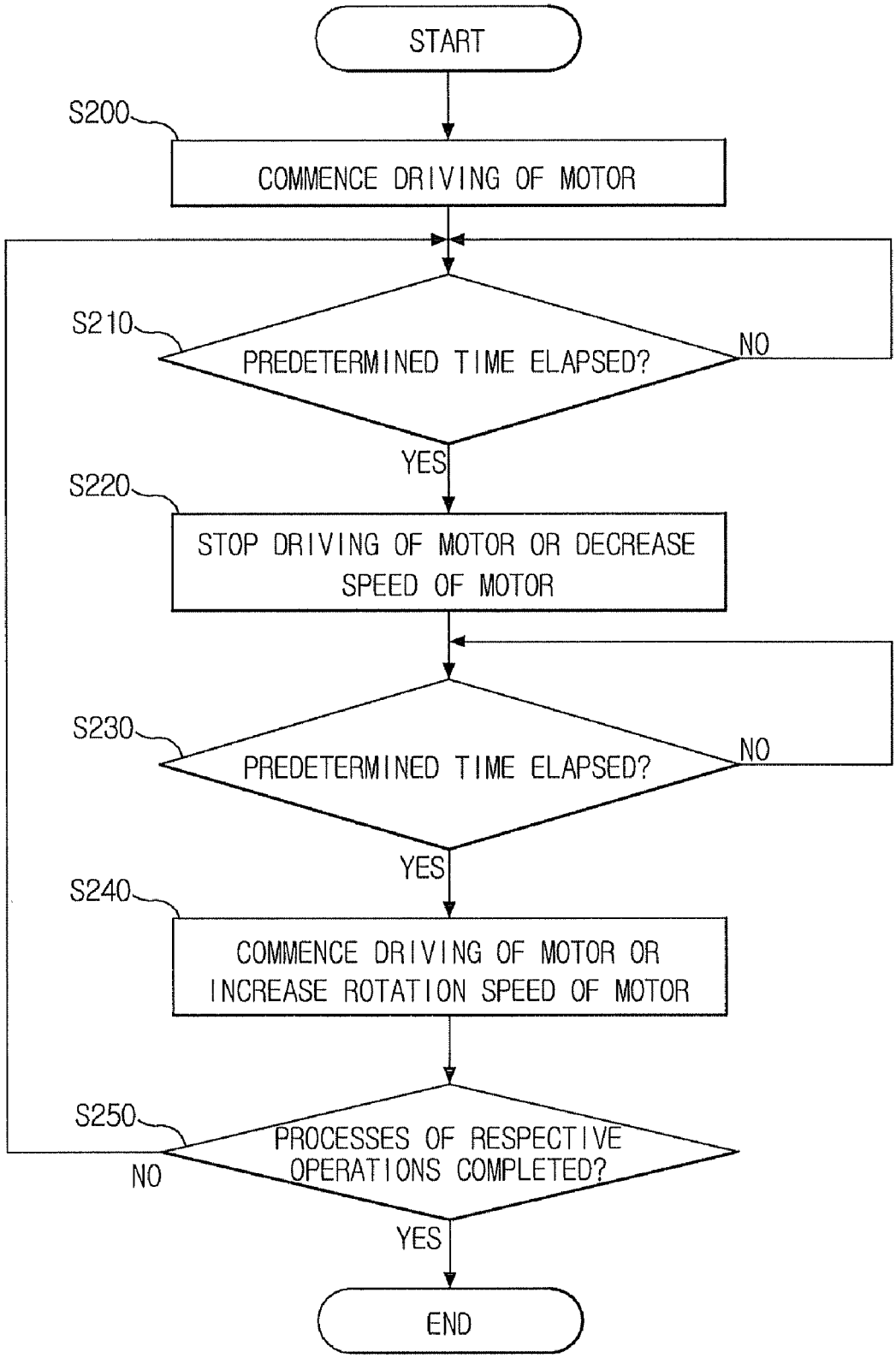
Figure 6D:
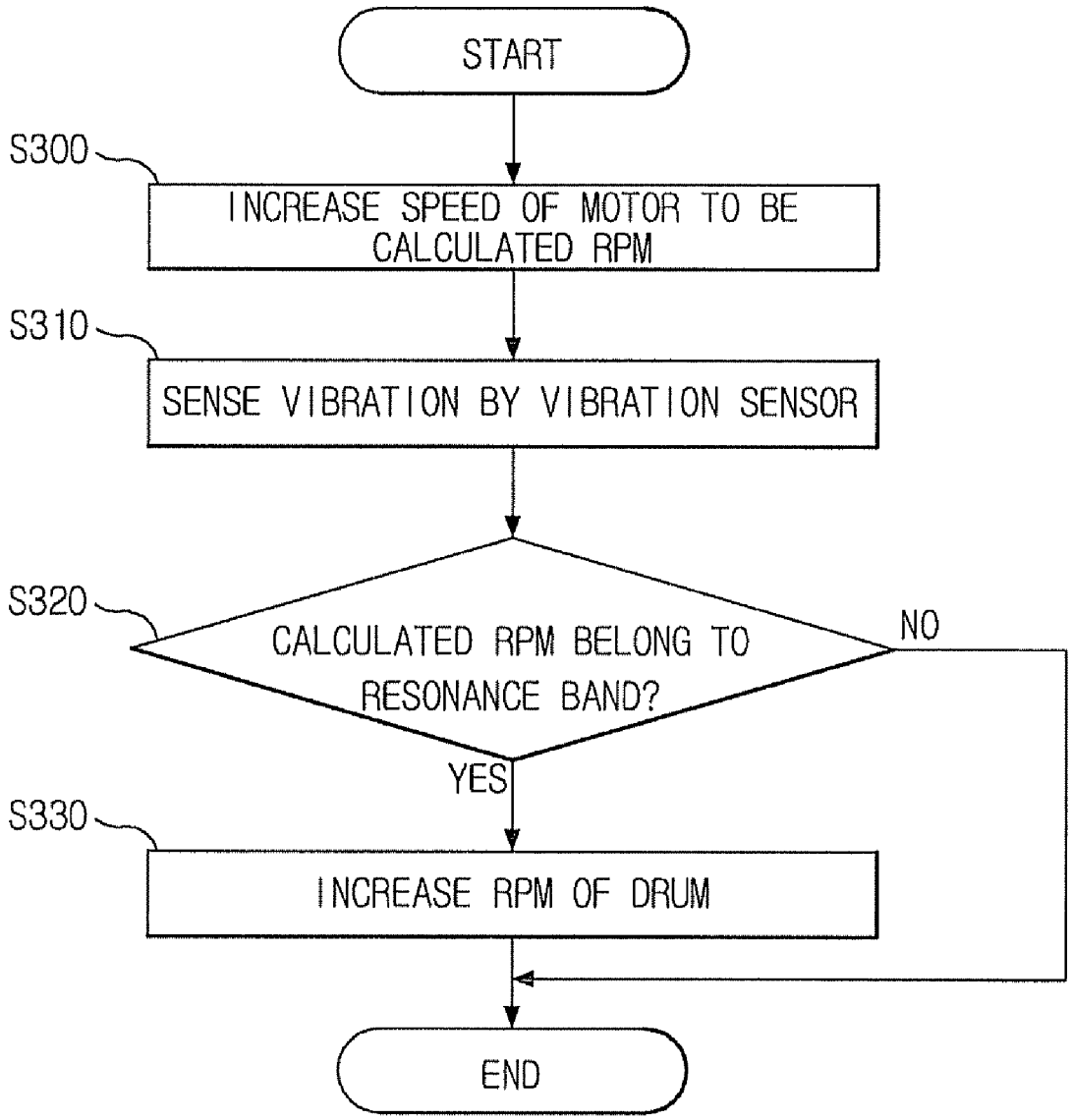
FIG. 6D is a control flow chart illustrating a resonance control procedure according to an embodiment of the present invention.

FIG. 6A is a flow chart illustrating a tub washing process of the washing machine according to an embodiment of the present invention, FIGS. 6B and 6C are flow charts illustrating printed circuit board (PCB) (or motor) control procedures according to embodiments of the present invention, and FIG. 6D is a control flow chart illustrating a resonance control procedure according to an embodiment of the present invention.

As shown in FIG. 6A, when tub washing course is performed, water is supplied such that heated water and vapor can sufficiently sterilize and wash the entire water tub 11 during the rotation of the drum. The volume of the water is obtained by Equation ① above (S10).

The supplied water is heated to a predetermined sterilization reference temperature sufficient to sterilize microorganisms (for example, 70□) by the washing heater. At the same time, the stirring of the drum is performed to accelerate the heating of the water, and a PCB (motor) control procedure, which will be described below with reference to FIGS. 6B and 6C, is performed (S20).

Meanwhile, the stirring speed of the drum is a speed at which the vapor of the water supplied according to Equation ① can reach the top of the water tub 11. The rotation speed of the drum for this is obtained by Equation ②.

Subsequently, when the temperature of the water reaches the sterilization reference temperature, the washing heater 16 is controlled to be on/off to maintain the temperature of the water, and the drum 12 is continuously stirred to sterilize the microorganisms in the washing machine. Also, the PCB (motor) control procedure to control the driving of the PCB (or motor), which will be described below with reference to FIGS. 6B and 6C, is performed (S30).

Subsequently, replenishment water is supplied into the water tub 11 to rinse out the sterilized microorganisms and organisms. At this time, the volume of the replenishment water is controlled by Equation ③. That is, water sufficient to wet the entire water tub 11 by the rotation of the drum is replenished into the water tub 11 (S40).

Subsequently, when the supply of the replenishment water according to Equation ③ is completed, the drum is rotated at a high speed to rinse out contaminants in the drum. At the same time, the PCB (motor) control procedure, which will be described below with reference to FIGS. 6B and 6C, and a resonance control procedure, which will be described below with reference to FIG. 6D, are performed. At this time, the rotation speed of the drum is decided by Equation ④ such that the rinsing operation is performed with the maximum efficiency in correspondence to the volume of the replenishment water, and the water supplied into the water tub 11 wets the entire water tub 11 (S50).

When the rinsing operation by the execution of the resonance control procedure and the PCB (motor) control procedure and the high-speed rotation of the drum is completed, a drainage process is performed (S60).

Hereinafter, the PCB (motor) control procedure, used at operations S20, S30, and S50, will be described with reference to FIGS. 6B and 6C.

FIG. 6B is a flow chart illustrating a PCB (motor) control procedure according to an embodiment of the present invention.

As shown in FIG. 6B, when the PCB (motor) control procedure is commenced, the controller 31 controls the motor 15 to be driven. However, when the motor 15 has already been driven before the respective operations at which the PCB (motor) control procedure is used, the driving of the motor 15 may be maintained, or the rotation speed of the motor 15 may be changed to be a speed controlled at the respective operations (S100).

The controller 31 confirms the temperature of the PCB (or motor) to control the driving of the PCB (the speed and on/off intervals of the motor). That is, a temperature sensor (not shown) is attached to the motor 15 or a predetermined part (for example, intelligent power module (IPM)) of the PCB, which is an internal component of the controller 31 to control the washing machine, and the temperature information of the PCB (or motor) is transmitted from the temperature sensor to the controller 31 in real time (S110).

Subsequently, the controller 31 determines whether the temperature change of the PCB (or motor) is equal to or greater than a reference temperature. The reference temperature may be arbitrarily set. When the reference temperature is set to be 3 degrees at the time of manufacturing the washing machine, the controller 31 confirms whether the temperature change of the PCB is greater by 3 degrees or more (for example, 38 degrees or more) than the initial temperature when the temperature of the PCB is initially measured (for example, 25 degrees). However, the initial temperature of the PCB is renewed every cycle. On the other hand, when it is determined that the temperature change of the PCB (or motor) is less (for example 25 to 28 degrees) than the initial temperature, the procedure is fed back to operation S110 (S120).

Subsequently, when it is determined that the temperature change of the PCB (or motor) is greater than the reference temperature, the controller 31 controls the driving of the PCB to be stopped or the driving force of the PCB to be reduced to stop the driving of the motor 15 or reduce the rotation speed of the motor 15. This is to control the driving force of the motor to prevent the dropping of the safety of the PCB due to the continuous increase in temperature of the PCB (S130).

Subsequently, the controller 31 confirms the temperature of the PCB (or motor), and confirms whether the temperature change of the PCB (or motor) is equal to or greater than the reference temperature. For example, when the temperature measured immediately after stopping the driving of the motor 15 or reducing the rotation speed of the motor 15 at operation S130 is 28 degrees, the controller 31 confirms whether this temperature drops to be equal to or less than the reference temperature. That is, when the reference temperature is 2 degrees, it is determined whether the temperature of the PCM becomes 26 degrees. The initial temperature measured at peration S130 is renewed every cycle (S140 and S150).

Subsequently, when it is determined at operation S150 that the temperature of the PCM is equal to or greater than the reference temperature, the PCB is driven to commence the driving of the motor 15, or the driving force of the PCB is increased to increase the rotation speed of the motor 15 (S160).

Subsequently, the controller 31 determines whether the processes of the respective operations have been completed. That is, it is determined at operation S20 whether the temperature of the wash water has reached the sterilization reference temperature (for example, 70 degrees), and it is determined at operations S30 and S50 whether operation times set for the respective operations have elapsed. When it is determined that the processes of the respective operations have been completed, the controller 31 stops the PCB (motor) control procedure, and subsequent operations of the respective operations S20, S30, and S50 are performed. On the other hand, when it is determined that the processes of the respective operations have not been completed, the procedure is fed back to operation S110 (S170).

FIG. 6C is a flow chart illustrating a PCB (motor) control procedure according to another embodiment of the present invention.

As shown in FIG. 6C, when the PCB (motor) control procedure is commenced, the controller 31 controls the motor 15 to be driven. However, when the motor 15 has already been driven before the respective operations at which the PCB (motor) control procedure is used, the driving of the motor 15 may be maintained, or the rotation speed of the motor 15 may be changed to be a speed controlled at the respective operations (S200).

Subsequently, the controller 31 confirms whether a predetermined time has elapsed. When the controller 31 has determined that the predetermined time has elapsed, the controller 31 controls the driving of the motor 15 to be stopped or the rotation speed of the motor 15 to be reduced. This is an operation performed to prevent the continuous increase in temperature of the motor 15 or the PCB to drive the motor 15 (S210 and S220).

Subsequently, the controller 31 confirms whether a predetermined time has elapsed. When the controller 31 has determined that the predetermined time has elapsed, the controller 31 controls the driving of the motor 15 to be commenced or the rotation speed of the motor 15 to be increased (S230 and S240).

Subsequently, the controller 31 determines whether the processes of the respective operations have been completed. That is, it is determined at Operation S20 whether the temperature of the wash water reaches the sterilization reference temperature (for example, 70 degrees), and it is determined at Operations S30 and S50 whether operation times set for the respective operations have elapsed. When it is determined that the processes of the respective operations have been completed, the controller 31 stops the PCB (motor) control procedure, and subsequent operations of the respective operations S20, S30, and S50 are performed. On the other hand, when it is determined that the processes of the respective operations have not been completed, the procedure is fed back to Operation S210 (S250).

FIG. 6D is a control flow chart illustrating a resonance control procedure according to an embodiment of the present invention.

As shown in FIG. 6D, when the resonance control procedure is commenced, the controller 31 increases the rotation speed of the motor 15 to be the RPM calculated according to Equation ④ described at Operation S50 (S300).

As the RPM of the motor 15 increase, the machine body of the washing machine vibrates. The vibration sensor 30 senses the vibration and transmits a vibration signal to the controller 31 (S310).

Subsequently, the controller 31 compares a growth gradient of the vibration signal transmitted by the vibration sensor 30 with a predetermined value a, and determines whether the vibration signal has entered a resonance band. When the controller 31 has determined that the vibration signal has entered the resonance band, the RPM of the drum 12 are increased to be RPM deviating from the resonance band (the excessive vibration section) (S320 and S330).

That is, when the motor 15 is rotated, the vibration sensor 30 measures the vibration. The controller 31 calculates a growth gradient of the vibration signal in real time according to the measured vibration value, and determines whether the vibration signal has entered the resonance band according to the calculated growth gradient of the vibration signal. When it is determined that the vibration signal has entered the resonance band, the controller 31 controls the RPM of the motor 15 to increase such that the vibration signal deviates from the resonance band. As the vibration signal deviates from the resonance band, the noise and the vibration are reduced.

In accordance of one aspect of the present invention, the water supplied to wash the tub is uniformly distributed over the entire surface of the tub. Also, the amount of the water supplied to remove a contaminated film and the rotation of the drum are controlled. Consequently, the present invention has the effect of effectively performing the tub washing with low power consumption.

In accordance of another aspect of the present invention, the temperature of the unit such as the motor or the PCB is determined during the tub washing, and the rotation state of the drum is controlled according to the determined temperature. Consequently, the present invention has the effect of safely performing the tub washing with low power consumption.

In accordance of a further aspect of the present invention, it is determined whether the RPM of the motor belong to the resonance band with respect to the vibration of the washing machine during the tub washing, and, when it is determined that the RPM of the motor belong to the resonance band, the RPM of the motor are raised or lowered such that the RPM of the motor deviate from the resonance band. Consequently, the present invention has the effect of reducing vibration or noise during the tub washing.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A control method of a washing machine, comprising:

supplying water to a water tub during tub washing;

heating, by the washing machine, the supplied water;

rotating, by the washing machine, a drum at a speed at which the supplied water uniformly reaches a top of the water tub, to wash the water tub and the drum, wherein a volume of the supplied water is determined by the washing machine by the following equation:

$$V_{W1}=(V_T-V_D)/(2\sim3)$$

where $V_{W1}$ =the volume of the supplied water, $V_T$=a volume inside the water tub, and $V_D$=a volume inside the drum.

2. A control method of a washing machine, comprising:

supplying water to a water tub during tub washing;

heating, by the washing machine, the supplied water;

rotating, by the washing machine, a drum at a speed at which the supplied water uniformly reaches a top of the water tub, to wash the water tub and the drum, wherein the rotating comprising determining a rotation speed of the drum in reverse proportion to a volume of the water supplied.

3. The control method according to claim 2, further comprising determining the rotation speed of the drum by the following equation:

$$RPM=(V_T-V_D)/(2\sim3)*(15\sim20)$$

where RPM=revolutions per minute of the drum, $V_T$=a volume inside the water tub, and $V_D$=a volume inside the drum.

4. A control method of a washing machine, comprising:

supplying water to a water tub during tub washing;

heating, by the washing machine, the supplied water;

rotating, by the washing machine, a drum at a speed at which the supplied water uniformly reaches a top of the water tub, to wash the water tub and the drum;

replenishing a predetermined volume of replenishment water to the water tub after washing the water tub and the drum; and rotating the drum, at a speed at which the replenishment water uniformly reaches the top of the water tub, to rinse the water tub and the drum.

5. The control method according to claim 4, further comprising determining the volume of the replenishment water by the following equation.

$$V_{W2}=(V_T-V_D)/(1.8\sim2.2)-V_{W1}[L]$$

Where, $V_{W2}$=the volume of the replenishment water, $V_{W1}$=a volume of the supplied water, $V_T$=a volume inside the water tub, and $V_D$=a volume inside the drum.

6. The control method according to claim 4, further comprising determining the rotation speed of the drum to rinse the water tub and the drum in reverse proportion to the volume of the water supplied at the replenishment operation.

7. The control method according to claim 6, further comprising determining the rotation speed of the drum to rinse the water tub and the drum by the following equation $$RPM=(V_T-V_D)/(1.8\sim2.2)*(20\sim30)$$

where RPM=revolutions per minute of the drum, $V_T$=a volume inside the water tub, and $V_D$=a volume inside the drum.

* * * * *

UNITED STATES PATENT AND TRADEMARK OFFICE

CERTIFICATE OF CORRECTION

PATENT NO. : 8,020,231 B2
APPLICATION NO. : 12/403450
DATED : September 20, 2011
INVENTOR(S) : In Ju Lee et al.

It is certified that error appears in the above-identified patent and that said Letters Patent is hereby corrected as shown below:

Column 12, Line 29, In Claim 5, delete "equation." and insert -- equation: --, therefor.

Column 12, Line 32 (Approx.), In Claim 5, delete "Where," and insert -- where, --, therefor.

Signed and Sealed this
Twenty-eighth Day of February, 2012

David J. Kappos

David J. Kappos
*Director of the United States Patent and Trademark Office*